United States Patent [19]

Schaub

[11] 4,399,952

[45] Aug. 23, 1983

[54] THREAD DELIVERY APPARATUS

[75] Inventor: Werner Schaub, Riken, Switzerland

[73] Assignee: Schaub & Cie AG, Vordemwald, Switzerland

[21] Appl. No.: 236,647

[22] Filed: Feb. 23, 1981

[30] Foreign Application Priority Data

Mar. 3, 1980 [CH] Switzerland ..... 1680/80

[51] Int. Cl.[3] ..... B65H 51/24

[52] U.S. Cl. ..... 242/47.05

[58] Field of Search ..... 242/47.05, 47.04, 47.06, 242/47.07, 47.08, 47.09, 47.12, 47.01, 47.13; 66/132 R; 139/452

[56] References Cited

U.S. PATENT DOCUMENTS

| | | | |
|---|---|---|---|
| 3,709,444 | 1/1973 | Tannert | 242/47.04 |
| 3,796,386 | 3/1974 | Tannert | 242/47.05 X |
| 4,102,509 | 7/1978 | Paepke | 242/47.05 X |
| 4,271,686 | 6/1981 | Memminger et al. | 242/47.01 X |

FOREIGN PATENT DOCUMENTS

| | | | |
|---|---|---|---|
| 2723965 | 11/1978 | Fed. Rep. of Germany | 242/47.05 |
| 967095 | 3/1950 | France | 242/47.05 |
| 493965 | 10/1938 | United Kingdom | 242/47.05 |

*Primary Examiner*—Stanley N. Gilreath
*Attorney, Agent, or Firm*—Charles A. Blank

[57] ABSTRACT

A thread delivery apparatus for textile machines comprises a pair of nested wheels inclined one relative to the other for accepting multiple turns of yarn. Instead of the axes of the wheels passing each other with a finite minimum spacing as with nested godet wheel frames, the axes (18, 19) are in a common plane and intersect at a point (20) outside the thread control zone in the plane of a centering disc (23.1) fast on one of the wheels. The drive is transmitted from one wheel to the other through the centering disc.

8 Claims, 8 Drawing Figures

3
4
10'
12.1
16
18
19
18, 19

THREAD DELIVERY APPARATUS

To ensure trouble-free supply of the thread to thread-processing machines, more particularly textile machines, it is particularly important to supply the thread to the processing place at a specific speed and a minimum tension which is an constant as possible. It is conventional practice, for example, in the case of knitting, warp knitting, spooling and other textile machines, to draw the thread from bobbins. As the thread is removed, the diameter of the thread reserve on the bobbin diminishes and depending on the withdrawal device, the angle at which the thread is drawn off the bobbin also varies. This changes the thread draw-off tension, a feature which, in the absence of regulating procedures, can give rise to undesirable reactions on the finished material, even if the variations are slight. Furthermore, due to the thread turns adhering to each other the thread is frequently paid off jerkily from the bobbin so that the risk of thread breakage increases.

To avoid these disadvantages the prior art already discloses a large number of devices in which the thread, drawn off from the bobbin or package, is guided in several turns over cylindrical or slightly conical rollers which cooperate in pairs as godet wheels. In godet wheel frames the two wheels or rollers are situated at an angle to each other, with the axis of one wheel tilted about a radius drawn to the axis of the other. These devices absorb, through frictional engagement of the yarn with the wheel, inequalities in the inlet thread tension and also separate the individual yarn turns towards the delivery side in order to avoid frictional engagement between adjacent turns of yarn and thus to achieve a practically uniform thread tension on the pay off side. Examples of such devices are disclosed in U.S. Nos. 2,074,022, 2,977,746 and others.

While the devices constructed with two rollers in the form of godet wheel frames are able to ensure separation of the thread turns, at least in the pay-off zone, the original models were either of extensive and space consuming construction or they were difficult to adjust. Their disadvantage was the need for setting relatively large roller masses in motion, creating on the one hand large moments of inertia and on the other hand substantial driving mechanisms which were subject to wear. A low input power is however essential for thread delivery apparatus. Also the shafts of early godet wheels were disposed at a distance from each other, which gave rise to another technological difficulty: threads can be drawn off only tangentially from the pay-off cylinder, so that the so-called overhead draw off (as from a single yarn storage wheel) is not possible.

It was possible partially to avoid these disadvantages by reducing the inter-axis distance between the two wheels or rollers until the two godet wheels became nested within each other in the form of a cage-like device. In this respect, reference may be made to the U.S. Pat. No. 2,289,390. However this nested godet wheel assembly, like other godet wheels, has a further disadvantage in that each unit can in practice be operated in only one direction of rotation, dictated by the inclination of one wheel or roller relative to the other and parallel offset axis. As the successive turns of yarn are moved over the wheels or rollers, they are transferred axially of the wheels or rollers from a yarn inlet zone to a yarn pay-off zone, in the direction dictated by the inclination of the two axes. According to the crossing point of the two parallel offset axes, the circumference of the eliptical crosscut form does increase (DE-OS Nos. 26 10 709, 27 23 965). Therefore increased thread tension does according at the pay-off zone. Any attempt to rotate the wheels in the opposite direction would result in a tendency for the successive yarn turns to move from the inlet zone axially away from the pay-off zone, with a consequent increase in tension and overlapping of successive yarn turns. For textile processing machinery which tends to drive the wheels in this reverse direction, therefore, a separate nested godet wheel frame must be supplied, with the tilt and separation of the wheels or rollers being the mirror image of those originally discussed. This poses suppliers with the problem of matching the delivery apparatus to the machinery with which it is to be used.

Thread delivery apparatus have also been developed in which the thread supply is axially moved on a coiling member by mechanical sliding means. Apparatus of this kind as described in Swiss Pat. No. 517 854 and German Offenlegungsschrift No. 2 461 746 is the most widely used and operates in both directions of rotation.

There is also thread delivery apparatus with a two-step winding member and a rotating oscillating control part which controls thread coiling on a stationary member. Apparatus of this kind is described, for example in U.S. Pat. No. 3,224,446, German Pat. No. 1 288 229, German Auslegeschrift No. 1 942 062, and German Pat. No. 1 967 177. The apparatus, more particularly that described in the last-mentioned publications, is very expensive and often of very complicated construction, with the thread turns being pushed or slid onto the winding member. The thread is subjected to several changes of direction and, a particularly detrimental feature, the individual thread turns are positioned so close to each other that they can become tangled. This leads to a very unfavourable thread pay-off with corresponding thread tension differences. Thread delivery apparatus of this kind is unable to equalize thread inlet tension differences in the way in which this is possible, for example, on godet wheel frames.

It is therefore an object of the present invention to provide a thread delivery apparatus which can be constructed in compact form and demands only a low input power, and which can be operated in both directions while still effectively delivering the thread to the pay-off zone at a controlled low tension.

The invention provides thread delivery apparatus comprising a pair of nested wheels inclined one relative to the other for accepting multiple turns of a yarn, the periphery of each wheel being defined by a circular array of rods, wherein the axes of the nested wheels are in a common plane and intersect outside of a thread control zone.

It was never previously appreciated that the alignment of two mutually inclined wheels in the same plane would give a feedwheel assembly analogous to a nested godet wheel frame but operable in both directions of rotation. Indeed there was a strong belief not only that the spacing of the axes of a godet wheel frame was necessary, but that it dictated the amount by which the yarn turns were advanced along the wheels each revolution (see for example U.S. Pat. No. 4,102,509).

Preferably the wheels comprise a driving wheel and a driven wheel the axes of which intersect in the general plane of a centering disc which is perpendicular to one of the axes and has a circular array of apertures slidably accepting the peripheral rods of the other of the wheels.

The driving wheel may be rotatably mounted on a spindle that is fast to a body of the apparatus, and the driven wheel may be rotatably mounted on a spigot that extends eccentrically from a shoulder portion of the spindle. Drive to the driving wheel may be via a driving belt. Alternatively the driving wheel may be mounted on and driven by a rotatable driving spindle, and the driven wheel may be rotatably mounted on a spigot that extends from a mounting for the spindle, eccentrically of the spindle. In either case drive from the driving wheel to the driven wheel is advantageously through the centering disc.

It is a particular advantage that the thread delivery apparatus according to the invention can provide a practically constant delivery thread tension down to 0.5 gram. The inlet thread tension should amount to at least approximately 4 gram in order to avoid slip. The minimum number of yarn turns to be placed on the active surface of the solid of rotation depends on the kind of yarn or its tendency to slip. By suitable choice of the length of the active surface area of the solid of rotation it is possible to provide apparatus which, although calling for minimum space, is able to accommodate a thread supply which is sufficiently large to ensure that in the event of thread breakage the textile machine can restarted after only a short interruption.

The invention is hereinafter explained in exemplified form by reference to the accompanying drawings in which.

Figure 3B:
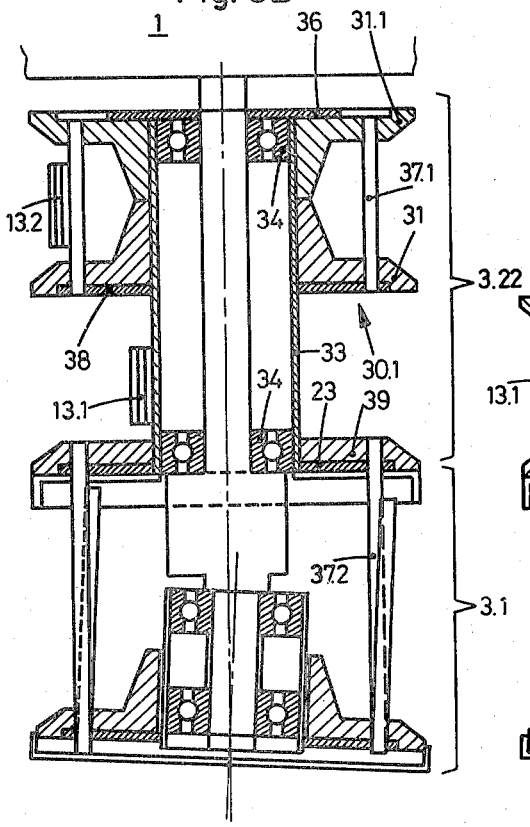
Figure 3A:
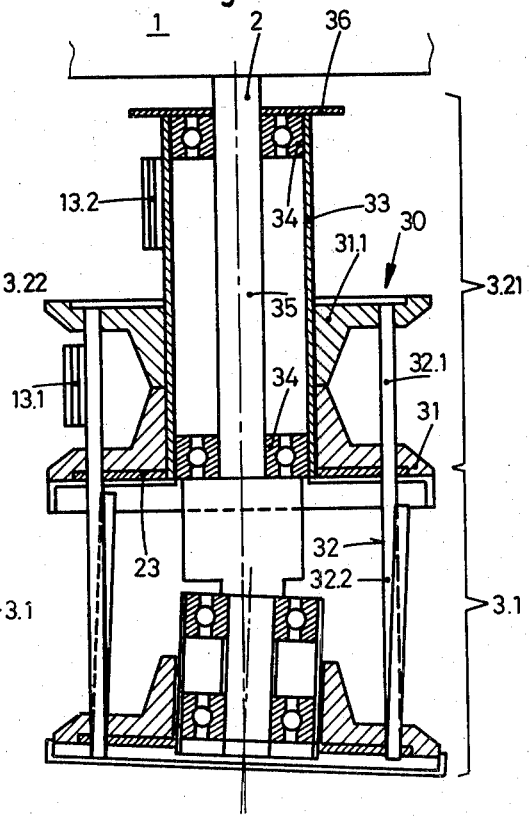
Figure 4:
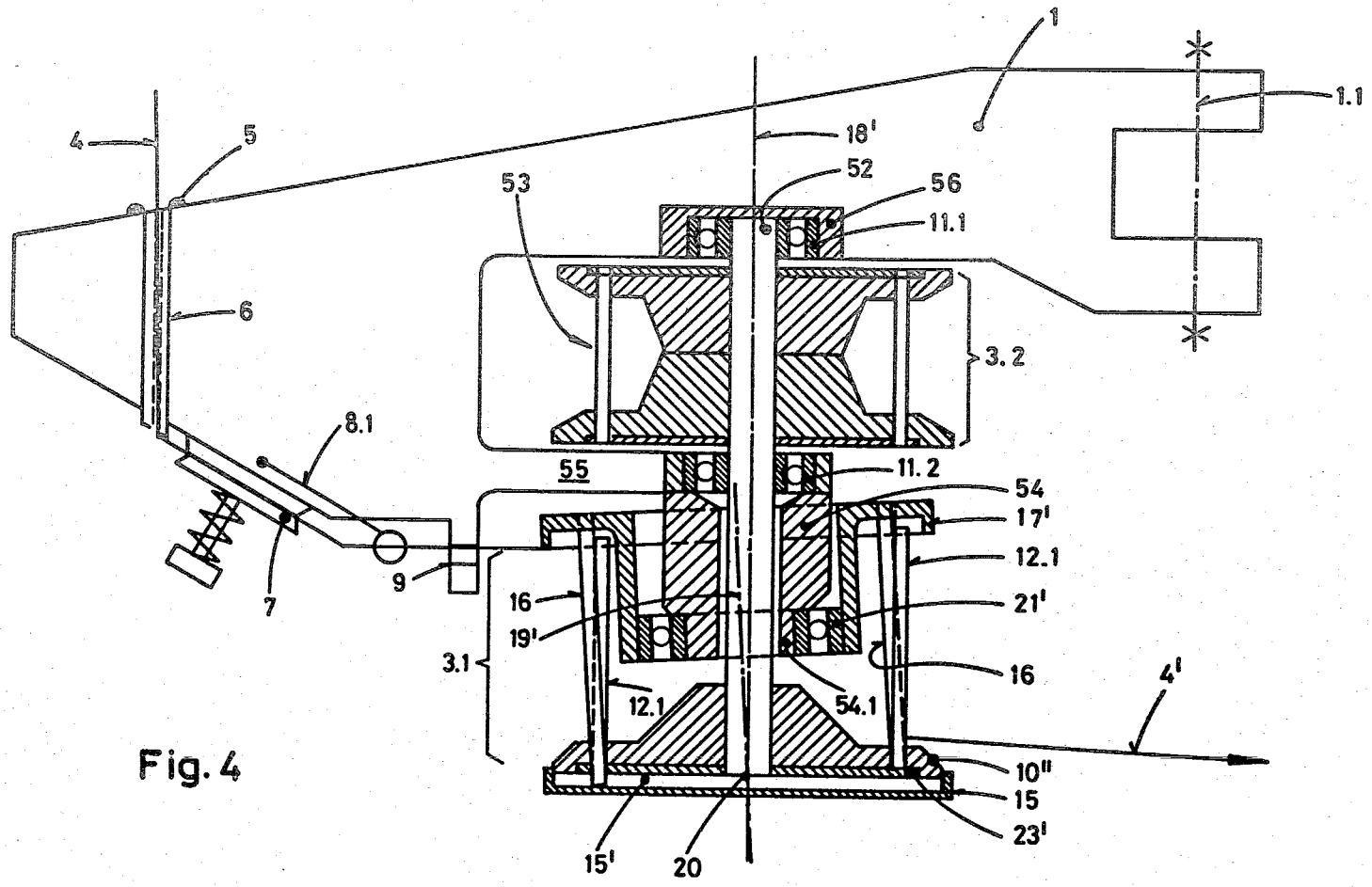

FIGS. 3A and 3B are axial sections through the thread storage and feed wheels of two modified embodiments of a thread delivery apparatus according to the invention wherein the thread storage and feed wheels can be driven by either of two alternative driving belts; and FIG. 4 is a side view of a thread delivery apparatus according to another embodiment of the invention with the thread storage and feed wheels shown in section.

Figure 1A:
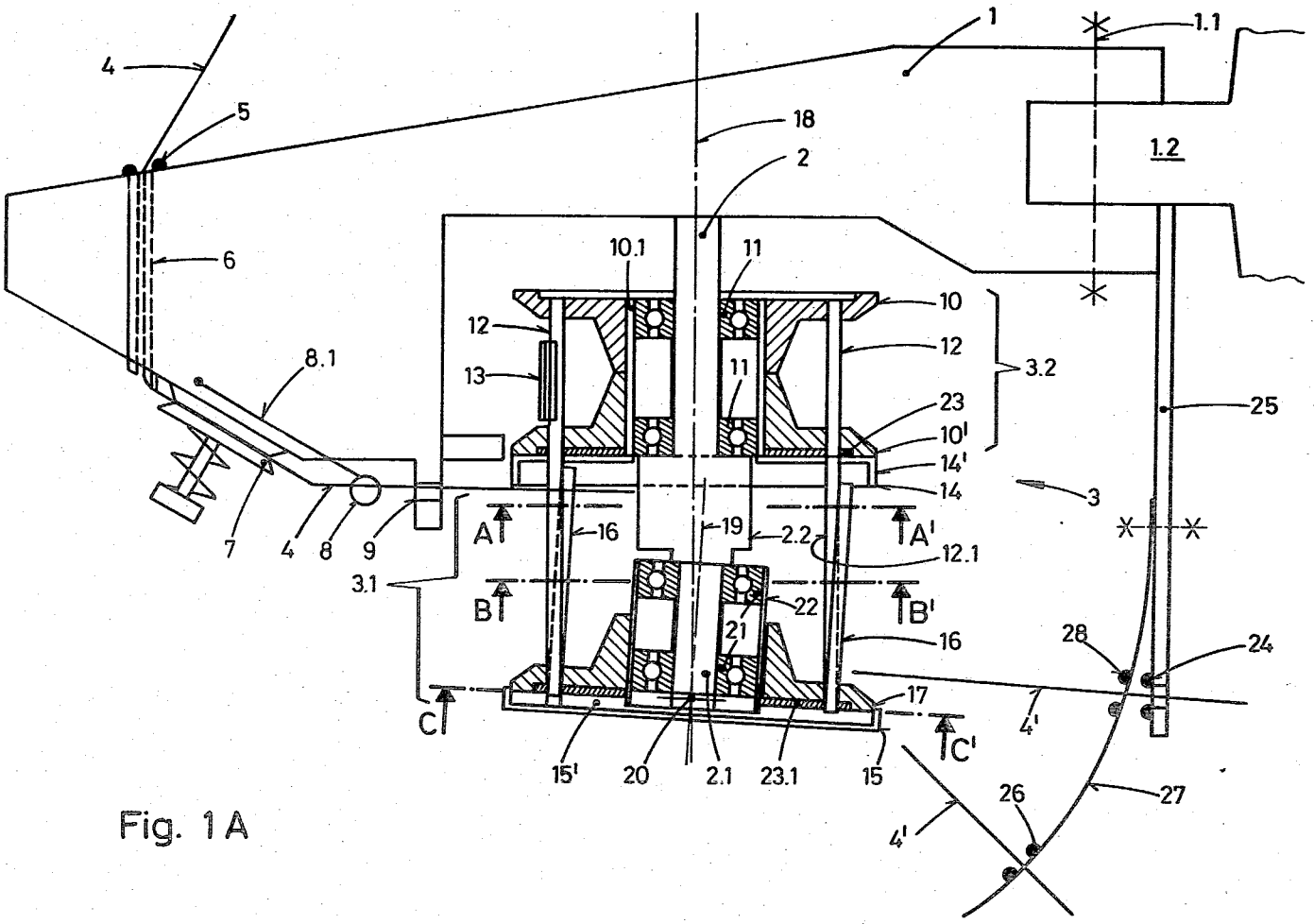
FIG. 1A is a side view of a thread delivery apparatus according to the invention with the thread storage and feed wheels shown in section.

Referring first to FIGS. 1A, the apparatus comprises a support frame 1 which is attached, for example by means of a screw connection 1.1, to the support bracket 1.2 of a textile machine (not shown). The apparatus support frame 1 contains retaining means, not shown in detail, for the spindle 2 of a thread feed wheel assembly 3, shown as a vertical section and in this case arranged in suspended form, for the uniform supply of a thread 4, 4' to a processing place of the textile machine. The thread 4 passes via an eyelet 5 and a tube 6 through pair of cymbals 7 designed to impart a specific prestress to the thread which has already been "passified" in the tube 6. Thereafter the thread 4 passes through an eyelet 8 at the end of a support arm 8.1 which is advantageously constructed as the operating lever of a stop motion device, not shown, associated with the appropriate textile machine and adapted to respond to thread breakage. The thread 4 then passes through a guide hole 9 on to a feeder section 3.1 of the thread/feed wheel assembly 3 which can be rotated by means of a driving section 3.2, which is coaxially supported on the spindle 2.

The driving section 3.2 comprises a driving pulley consisting substantially of two flanged sleeves 10,10', which are conveniently constructed one as the mirror image of the other. The flanged sleeves 10, 10' are disposed on a hub bush 10.1 which is rotatably supported on the spindle 2 by means of ball bearings 11. Pins 12 are inserted in bores in a circular array coaxial with the flange sleeves 10, 10'. The spacing between adjacent pins corresponds to the tooth pitch of a toothed belt 13 or corresponds to a multiple of such pitch, and the pin diameter is equal to the width of the tooth gaps in the toothed belt 13. The pins 12 between the flanged sleeves 10, 10' are therefore in positive mesh with the toothed belt 13 to drive the feed wheel assembly 3.

The feeder section 3.1 of the thread feed wheel assembly 3 extends from an annular disc 14, attached to the lower flanged sleeve 10' of the driving section 3.2 to an end cover disc 15 on the lower face of the thread feed wheel assembly 3. A two-part rotatable cage structure, comprising two groups of rods 12.1 and 16, is disposed therebetween. Each rod 12.1 is an axial projection of a corresponding rod 12. The rods 12.1 of the first group are mounted on and depend from the lower flanged sleeve 10', whereas the rods 16 of the second group are mounted on and are upstanding from a third flanged sleeve 17 which is situated at the lower end region of the feeder section 3.1. Both parts of the cage structure are attached to the spindle 2. A middle section 2.2 of the spindle structure is constructed as an elongated shoulder of larger diameter from the lower end of which depends a spigot 2.1 which is arranged eccentrically of and at an acute angle to the section 2.2. The third flanged sleeve 17 with its rods 16 rotates about the spigot 2.1 on ball bearings 21 which are disposed within a hub bush 22 supporting the flanged sleeve 17.

At this point it should be noted that the flanged sleeves 10, 10' and 17 are advantageously of identical construction and are provided with bores of substantially identical relative position and size. They are preferably made of plastics material.

Figures 2A, 2B, 2C:
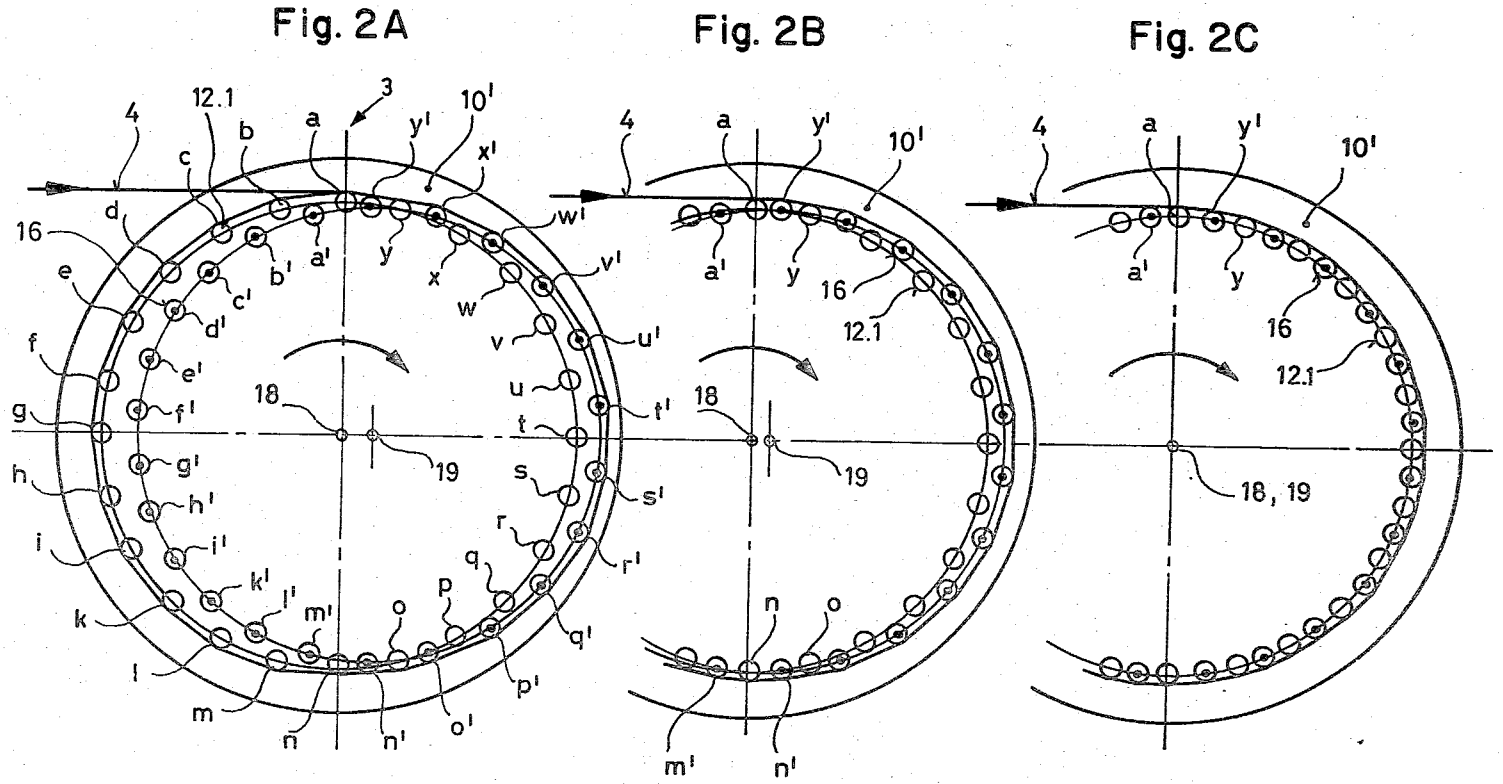
FIGS. 2A, 2B and 2C are cross-sections through the thread storage and feed wheels of FIGS. 1A to illustrate the manner of supporting the thread on the pins of that wheel which is concentric with the support spindle and on the pins of that wheel inclined at an angle to the support spindle, the sections being taken along the planes A—A', B—B' and C—C' of FIG. 1A.

The axis 18 of the spindle 2 and of the middle section 2.2 lies in the same plane as the axis 19 of the spigot 2.1, so that the two axes actually intersect. The angle between the axes 18 and 19 is approximately 1.5° to 5°, and the point 20 of intersection of the axes is situated outside the thread control region of the feeder section 3.1. Perpendicularly to the axis 19 of the spigot 2.1 and passing through the point 20 there extends a plane in which the distal ends of the rods 12.1 of the first group and the mounting end of the rods 16 of the second group are situated on a practically circular pitch line (FIG. 2C). Each of the rods 12.1 of the first group is disposed substantally midway between two rods 16 of the second group.

The rods 12.1 of the first group extend substantially parallel to the main axis 18 of the spindle 2 and the rods 16 of the second group extend substantially parallel with the axis 19 of the spigot 2.1 and the pitch circle diameters of the respective groups of rods are of precisely the same size.

Centering discs 23 and 23.1 of metal, which ensure precise alignment of the respective rods 12.1 and 16, are inserted into the appropriate flanged sleeves 10', 17.

The ends of the rods 12.1 of the first group extend into the flanged sleeve 17 and are retained with a light sliding fit in bores, each of which is disposed generally mid-way between two of the rods 16 of the second group, in the flanged sleeve 17 and in the centering disc 23.1. Owing to the angle of tilt between the spigot 2.1 and the spindle 2, the end portion of each of the rods 12.1, during their rotation about the spindle 2, performs an upward and downward motion relative to the flanged sleeve 17 and the ends of the rods 12.1 reciprocate in a cavity 15' formed between the centering disc 23.1 and the end cover 15. To avoid metal-to-metal contact between the ends of the rods 12.1 and the associated bore in the centering disc 23.1, to avoid metal abrasion, these bores can be lined with a "self-lubricating" plastics material or the rod ends can be provided with a corresponding plastics covering.

The ends of the rods 16 of the second group are received in a zone defined by a depending edge flange 14' of the annular disc 14, and each similarly performs oscillating motions relative to the axis of the flanged sleeve 10' as the flanged sleeve 17 rotates about the spigot 2.1. The flanged sleeve 17 is driven by the ends of the rods 12.1 which are held captive in the flanged sleeve 17 and the centering disc 23.1. The depth of the edge flange 14' is sufficient always to shield the ends of the rods 16 against accidental entry of the incoming thread 4 over and behind the rod ends.

Figure 1B:
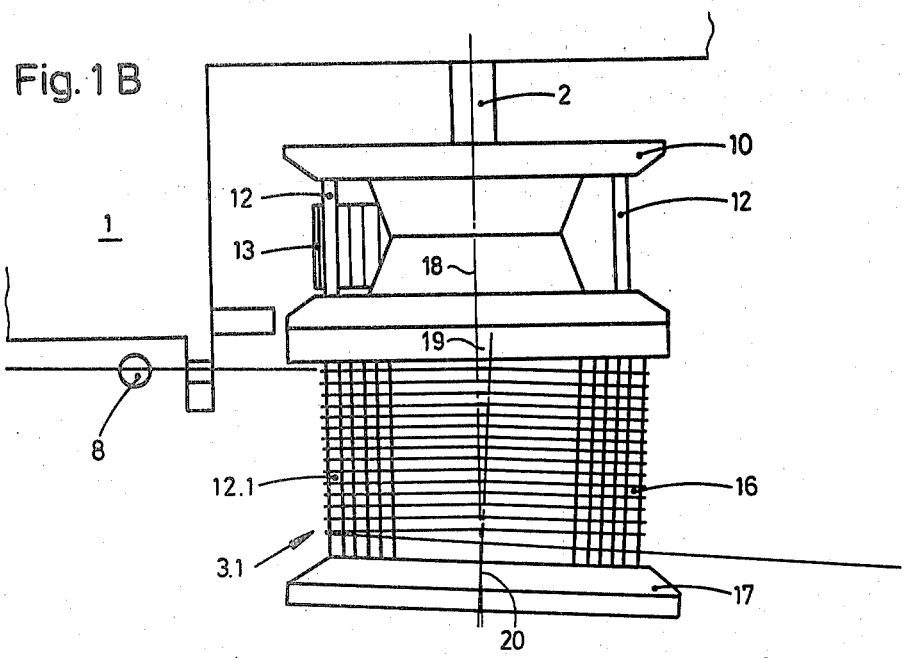
FIG. 1B is a side view of the thread storage and feed wheels according to FIG. 1A.

FIG. 1B indicates the manner in which a positive advancement of thread turns, axially with respect to the feeder section 3.1, is obtained by the skew positions of the axes 18 and 19. This thread advancement axially of the feeder section is known and recognized in connection with godet wheels.

By having the axes 18 and 19 intersect rather than merely pass each other with a minimum spacing, as in a godet wheel frame; by placing the point of intersection 20 outside the thread control zone of the thread feeder section 3.1; and by centering the rods 12.1 and 16 of both rod groups on the same previously-mentioned circular pitch line, the apparatus of the invention provides a feeder section 3.1 in which the generatrix successively merges from an oval into substantially a circle. The resultant solid of rotation has a progressively diminishing periphery, from its oval top region merging into its almost circular bottom region. This results in a reduction of the length of successive thread turns towards the thread pay-off side so that in addition to equalization of inlet tension differences due to the inlet stretching effect, there is also a reduction of the thread tension towards the thread exit. Practical tests have shown that inlet tension differences of 1 to 2 grams can be reduced to approximately 0.2 grams. The reduction of thread tension towards the thread exit can be accentuated by a slight conical convergence of the first rods 12.1 (and where appropriate also of the second rods 16) towards the thread pay-off end.

FIGS. 2A–2C confirm the above-mentioned arrangement. The relative position of the rods 12.1 and 16 in the three views relates to the planes A—A', B—B' and C—C' respectively of observation in FIG. 1A. Taking account of the fact that in the practical embodiment of the thread feeder section 3.1 the setting of the rods 12.1 and 16 of 1.5°–5° is much less than that shown in FIGS. 1A and 2 and only slight parallelity differences therefore exist between adjacent rods 12.1, 16 each of the rods associated with the two groups are shown "set to gap".

On the assumption that the thread feed wheel 3 rotates in the clockwise sense as viewed from below in FIG. 1A (as shown by the arrow in FIG. 2A), the thread initially runs onto one of the rods 12.1 of the first group at a tangent. This initial rod is marked a in FIG. 2A. On rotation of the wheel 10' the thread 4 is taken up by the adjacent rod a' of the second group, then by the adjacent rod b of the first group, and so on. The rods of the first group are, however, only lightly touched by the thread 4 at the top dead center position of the illustration in FIG. 2A, and as the wheel rotates through its first 180° from the position shown the thread is carried only by the rods 16 of the second group which move outside the rods 12.1 of the first group. As the axes 18 and 19 are inclined one relative to the other, the yarn is also transported longitudinally of the device as it is carried by the rods 16 of the second group, and is redeposited on the rods 12.1 of the first group at a position axially spaced from the initial feed level. When the rod a reaches the bottom position of the illustration in FIG. 2A it is again lightly touched by the thread 4 and on further rotation of the wheel 3 the thread 4 is transferred into contact with the rods 12.1 of the first group. During the next 180° of rotation of the wheel the yarn is carried by the rods 12.1 of the first group, and as the axis 18 is vertical it is not transported longitudinally of the device. Thus for each revolution the yarn is carried for approximately 180° by the rods 16 of the second group, to impart an axial advancement of the yarn along the device, and for 180° by the rods 12.1 of the first group with no such advancement.

Each of the FIGS. 2B and 2C shows only the right-hand half of the rod systems 12.1 and 16. Although the pitch circle eccentricity (defined by the spacing between the axes 18 and 19 in the different sectional planes A—A', B—B' and C—C' in FIG. 1A) amounts to approximately only half that of FIG. 2A in FIG. 2B, feeding and axial advancement of the thread proceeds precisely as already described above. It has surprisingly been found that the spacing between successive turns of thread on the wheels depends only on the angle between the two axes 18 and 19, and that the thread advancement is practically uniform over the entire thread control zone of the thread feeder section 3.1. At no stage does zero feed or advancement occur because the concentric rod distribution of FIG. 2C does not exist at any axial position within the thread control zone but only in the plane C—C' in which axes 18 and 19 intersect.

The apparatus of the invention offers a considerable advantage over such nested godet wheel frames in that the wheels can be driven in either direction without any loss of yarn control. With the thread feed wheel assembly 3 rotating in the opposite direction the thread in FIGS. 2A–2C is fed from the right. The thread is then fed initially to the rods 16 for the first half revolution of the device. A thread advancement axially of the device, as described above will also be obtained in this case because the axis 19 about which the rods 16 move is inclined to the axis 18.

The thread delivery apparatus according to the invention operates in the manner described whether it is used in the illustrated suspended position, or used with a horizontal or vertically upwardly oriented spindle 2. As shown in FIG. 1A the thread can be drawn off tangentially over a fixed draw-off eyelet 24 inserted in a support arm 25 or on the apparatus support 1, or the thread can be drawn off axially or "overhead". In the last-mentioned case the paid off thread 4' will pass through an eyelet 26 which is mounted on a spring steel wire or strip 27 which in turn can be connected to the support arm 25. Combining the eyelet 24 with an additional eyelet 28, which is slidably mounted in the spring steel strip 27, permits the use of the inventive thread delivery apparatus in textile machines with irregular thread consumption, for example knitting machines of the so-called Jacquard type or those with other than plain needle selections. The eyelets 26 and 28 can be combined in a single eyelet which is mounted alongside a slot in the spring steel strip 27.

Driving means, for example those providing a common drive for a plurality of apparatus combined into groups from a common drive source (motor etc) are used if the thread delivery apparatus according to the invention is employed with textile machines which have a substantial number of thread supply positons. Toothed belts, operating almost without slip, are particularly suitable to this end and call for a relatively small contact angle with the drive pulley in cases of small individual driving loads. The driving section of an individual unit can be constructed in accordance with FIGS. 3A or 3B while using a large number of identical components. Two driving sections 3.21 (FIG. 3A) and 3.22 (FIG. 3B) are shown, each drivingly coupled with one of two driving belts 13.1, 13.2 while each other driving belt 13.2, 13.1 is guided freely past the driving section of the adjacent device. In principle, the thread feeder sections 3.1 in FIGS. 3A and 3B are constructed as already described by reference to FIGS. 1 and 2. FIG. 3A shows a driving pulley 30 which is combined with the thread feeder section 3.1 as shown in FIGS. 1A and 1B, with rods 32 extending through and retained in the flanged sleeve 31. The portions 32.1 of the rods between the flanged sleeve 31 and an upper flanged sleeve 31.1 are provided for meshing with the toothed belt 13.1, whereas the depending portions projecting through the sleeve 31 form the first set of rods of the thread feeder zone. Both flanged sleeves 31 and 31.1 are mounted on an extended hub bush 33 which in turn is supported by means of ball bearings 34 on an elongated shaft portion 35 of the spindle 2 which is retained in the apparatus support 1. Advantageously, the external diameter of the hub bush 33 is constant over its entire length but at least in the region of the toothed belt 13.2 its diameter is such that the said toothed belt either rotates at a distance from the surface of the bush or bears only lightly on the bush surface. A cover disc 36 on the hub bush 33 protects the ball bearings against the ingress of dirt.

In FIG. 3B the toothed belt 13.2 passes over a driving pulley 30.1 which is placed on the end of the hub bush 33 situated on the side of the apparatus support 1. By contrast to the previously described constructions it is necessary to provide spatial separation between the thread feeder section 3.1 and the driving pulley 30.1 to provide a running path for the toothed belt 13.1. In particular this calls for physical separation of each of the rods of the first group into a pulley rod 37.1 and a feeder rod 37.2. The two flanged sleeves 31 and 31.1 comprise two identical components disposed in mirror image configuration on the hub bush 33 which in this case transmits the driving torque. The pulley rods 37.1 are secured on a separate metal disc 38. Mounting the feeder rods 37.2 is a flanged sleeve 39 which transmits torque from the hub bush 33 to the feeder rods. The feeder rods 37.2 operate as described with reference to FIGS. 1A and 1B.

With the feeder devices designed according to FIGS. 1A, 1B, and 3A, the rotating components of the sections 3.1 and 3.2 are rotatable on the spindle 2, firmly secure to the support frame 1, and its eccentric sections 2.1 and 2.2. The drive of the oblique flanged sleeve 17 arranged on the yarn delivery side (yarn 4') takes place via the pins 12 that are seated, on the one hand, in the flanged sleeves 10,10' forming the drive pulley and whose free ends engage, on the other hand, follower bores (not marked by reference numerals) in the oblique flanged sleeve 17. FIG. 4 illustrates an embodiment of the feeder device according to the invention in which the drive of the cage assembly has been shifted out of the flanged sleeves 10" and 17', as well as the pins 12.1 and 16 seated in these sleeves, to the opposite side.

The flanged sleeve 10" situated on the drive side is seated on a drive shaft 52 driven by a pulley 53 that can, in principle, be designed in the same way as the drive section 3.2 in FIG. 1A. The axis 18' of the drive shaft 52 which is rotatably secured to the support frame 1 in ball bearings 11.1 and 11.2 corresponds functionally to the axis 18 of FIG. 1A. The oblique positioning of the flanged sleeve 17' with respect to the axis 18' is brought about by means of a ball bearing 21' whose inner race is seated on an eccentric carrier 54 performing the same function as the central section 2.2 of the spindle 2 in FIG. 1A and is secured in a manner (not shown) to the support frame 1, respectively to a yoke 55 integral therewith. The yoke 55 supports at the same time the inner ball bearing 11.2 for the shaft 52, whereas the outer ball bearing 11.1 is seated in a bushing 56 likewise firmly connected with the support frame 1.

The eccentric carrier 54 provided with a central passage for the drive shaft 52 has an eccentric oblique shoulder 54.1 which corresponds functionally to the angle-mounted spigot 2.1 in FIG. 1A and carries the ball bearing 21' by means of which the obliquely positioned flanged sleeve 17' is rotatably borne. The oblique shoulder 54.1 on the eccentric carrier 54 is aligned with respect to the axis 19' which corresponds therefore functionally to the axis 19 in FIG. 1A.

Just as in FIG. 1A, the flanged sleeve 10" positioned perpendicular to the main axis 18' of the device carries therefore the pins 12.1 oriented parallel to the main axis 18'. It contains furthermore follower bores not designated in further detail which are being engaged by the pins 16 projecting perpendicularly from the obliquely oriented flanged sleeve 17' and thereby maintain the flanged sleeve 17' in drive connection. The securing of the pins 12.1 and 16 and the guiding of their ends in the region of the other flanged sleeve in each given case can be designed in principle in the same manner as described with reference to FIG. 1A. For overhead doffing of the unwinding yarn 4' even in the case of the design according to FIG. 4, the flanged sleeve 10" has on its delivery side an end cover 15 that provides a recess 15' outside the flanged sleeve 10", in which the ends of the obliquely positioned pins 16 oscillate.

I claim:

1. In thread delivery apparatus comprising:

a spindle having a shoulder portion and attached to the apparatus;

a driving wheel rotatably mounted on said spindle, said driving wheel including at its periphery a first circular array of rods;

a spigot extending eccentrically from said shoulder portion of said spindle;

a driven wheel rotatably mounted on said spigot, said driven wheel including at its periphery a second circular array of rods;

said first circular array of rods of said driving wheel extending to said driven wheel for driving said driven wheel and forming with said second circular array of rods of said driven wheel a thread control zone between said wheels;

the axes of said wheels being in a common plane and the angle between the axes of said spigot and said spindle being such that said axes of said wheels intersect outside said thread control zone;

said driving wheel comprising a mounting disc rotatably mounted on said spindle and supporting said first circular array of rods at the periphery of said driving wheel, and said driven wheel comprising a mounting disc rotatably mounted on said spigot and a centering disc which is secured to said mounting disc of said driven wheel and having a circular array of apertures, drive being transmitted from said driving wheel to said driven wheel by distal portions of said rods of said first array being slidably received in said circular array of apertures of said centering disc;

said axes of said wheels intersecting in the general plane of said centering disc, whereby rotation of said driving wheel and said driven wheel results in winding of a thread around said rods in said thread control zone with displacement of the turns of the thread occurring axially of said driven wheel.

2. Apparatus according to claim 1, wherein the centering disc is a metal disc.

3. Apparatus according to claim 1, which includes an annular disc having an edge flange and which is fast to said mounting disc for said first array of rods and wherein distal portions of said rods of said second array are freely received behind said edge flange.

4. Apparatus according to claim 1, which includes a driving belt for driving the driving wheel.

5. Apparatus according to claim 4 wherein said belt is a toothed belt and said apparatus includes adjacent drive rods that are in a circular array for receiving the teeth of said belt and are drivingly connected to said driving wheel.

6. Apparatus according to claim 5, wherein said adjacent drive rods are extensions of said rods of said first circular array.

7. Apparatus according to claim 5, which includes a bush for providing a driving connection between said adjacent drive rods and said driving wheel and for providing an axial spacing between said driving belt and said driving wheel.

8. Thread delivery apparatus with an apparatus support, and a thread feeder section, the input side of which tangentially receives the thread from a supply, which thread feeder section comprises a stationary spindle, first means which is rotatably supported on said stationary spindle, a feeder drum comprising first rods which partially define the generatrix of said feeder drum and are situated parallel with the axis of said spindle and at a uniform distance therefrom in the radial direction and at a uniform distance from each other in the circumferential direction, and said feeder section also comprising second means at a distance axially of said spindle from said first means, and said feeder section also comprising a bearing journal inclined at an angle to said stationary spindle and connected thereto and a bearing, on said journal, rotatably supporting said second means which are rotationally coupled to said first means, and said feeder drum also comprising second rods which terminatingly define the generatrix of said feeder drum and are situtated at radial and circumferential differences identical to those of the first rods in relation to said spindle axis and to each other and are positioned parallel to the axis of said inclined bearing journal, said feeder drum being formed by said first and second rods nesting with each other and said feeder drum having a thread delivery zone, characterized in that said spindle has a shoulder portion, that said second means include a centering disc which is positioned perpendicularly with respect to the axis of said bearing journal, that said bearing journal is so eccentrically coupled to said shoulder portion of said spindle that said axis of said bearing journal intersects with said axis of said spindle outside said thread delivery zone and the point of intersection is the center of rotation of said centering disc, and that said centering disc has mounted thereon, on a common pitch circle zone, on the one hand said second rods and on the other hand recesses in which the ends of the first rods are guided in longitudinally slidable configuration.

* * * * *